US006360543B2

(12) United States Patent
Koronya et al.

(10) Patent No.: US 6,360,543 B2
(45) Date of Patent: Mar. 26, 2002

(54) STEAM CONDENSER

(75) Inventors: Ferenc Koronya, Baden (CH); Guenter Schmalzbauer, Rheinfelden (DE); Vaclav Svoboda, Brimensdorf (CH)

(73) Assignee: Alstom (Schweiz) AG, Baden (CH)

( * ) Notice: Subject to any disclaimer, the term of this patent is extended or adjusted under 35 U.S.C. 154(b) by 0 days.

(21) Appl. No.: 09/779,663

(22) Filed: Feb. 9, 2001

(30) Foreign Application Priority Data

Feb. 9, 2000 (EP) ..... 00810112

(51) Int. Cl.[7] ..... F01K 17/00
(52) U.S. Cl. ..... 60/690; 60/685
(58) Field of Search ..... 60/685, 690, 692, 60/693

(56) References Cited

U.S. PATENT DOCUMENTS

| | | | | |
|---|---|---|---|---|
| 3,799,253 A | * | 3/1974 | Kelp | 60/690 |
| 3,881,548 A | * | 5/1975 | Budenholzer | 60/690 X |
| 4,059,959 A | * | 11/1977 | Matthews | 60/690 X |
| 4,253,516 A | | 3/1981 | Giardina | |
| 4,747,360 A | * | 5/1988 | Tuncel et al. | 60/690 X |

FOREIGN PATENT DOCUMENTS

| | | |
|---|---|---|
| CH | 414682 | 12/1966 |
| EP | 0128452 A1 | 12/1984 |
| EP | 0384200 A1 | 8/1990 |
| EP | 0594499 A1 | 4/1994 |
| EP | 0957325 A1 | 11/1999 |
| WO | WO98/15720 | 4/1998 |

* cited by examiner

*Primary Examiner*—Hoang Nguyen
(74) *Attorney, Agent, or Firm*—Burns, Doane, Swecker & Mathis, L.L.P.

(57) ABSTRACT

A steam condenser (1) which, relative to a steam turbine (2), is arranged at equal ground level and into which turbine steam flows in the horizontal direction through the condenser neck (3) has two or more modules **(4*a*, 4*b*) in which the steam condenses on cooling tubes (10). The modules (4*a*, 4*b*) are, in accordance with the invention, separated by a defined intermediate space (7). The central, mutually facing module walls (9) are supported and connected to one another by connecting parts (8). This arrangement contributes to a defined stress distribution in the central module walls (9). In a particular embodiment, bypass conduits (20), which lead the steam from the boiler directly into the steam condenser (1) while bypassing the turbine (2), are arranged in the intermediate space (7). For this purpose, the bypass conduits (20) lead to a steam introduction appliance (21), which is arranged at the condenser neck (3) at the level of the intermediate space (7). Because of this positioning, the flow of the turbine steam (22) into the steam condenser (1)** is not hindered.

18 Claims, 4 Drawing Sheets

STEAM CONDENSER

This application claims priority under 35 U.S.C. §§ 119 and/or 365 to Appln. No.00810112.3 filed in Europe on Feb. 9, 2000; the entire content of which is hereby incorporated by reference.

FIELD OF THE INVENTION

The invention relates to a steam condenser in a steam power installation or combined installation, which steam condenser is arranged, with the turbine, at ground level and to which the turbine steam flows in the horizontal direction through a condenser neck. The steam condenser has a plurality of tube bundles, which have an elongated configuration, are supported horizontally and are separated from one another by a central passage via which the steam flows into the tube bundles. An appliance for the introduction of steam which is fed via a bypass conduit from the boiler of the power installation directly into the condenser is arranged at the condenser neck.

BACKGROUND OF THE INVENTION

Such a steam condenser with horizontal steam inlet flow is, for example, described in EP 0 384 200. It has a plurality of bundles of tubes which have an elongated configuration, are arranged horizontally and through which the cooling water flows. The steam inlet flow from the turbine takes place in the horizontal direction via the condenser neck into the central passages and, from there, into the internal region of the tube bundles, where the steam condenses. The condensate forming on the tubes flows down over condensate collecting plates into a hotwell in the floor region of the condenser.

In practice, such a steam condenser is of modular construction, each module containing, for example, two tube bundles between which there is a free space or a central passage through which the steam can pass to the cooling tubes in the tube bundles. For space reasons, the modules are respectively arranged so that they lie one above the other, their central, horizontal module walls, which face an adjacent module, being connected to one another by assembly weld seams. The condensate which is produced in the tube bundles of the upper module flows to an opening at the bottom of each module. From there, it finally passes into the lower module and into the hotwell of the condenser.

Because of manufacturing tolerances, the welded connection between the central module walls involves the risk of a gap occurring along these module walls. In consequence, the contact surfaces are uneven at this location and uneven stresses occur. Particularly in the region of the drain opening for the condensate from the upper module to the lower module, these can lead to leaks and can introduce a corrosion risk. Because the module walls are located directly one above the other, it is impossible to inspect this corrosion visually and, if necessary, initiate a repair.

During the run-up and run-down of a power installation and during load rejection, steam from the boiler is supplied directly to the condenser via a steam bypass station. This is done for operational safety purposes and in order to reduce losses. Such a bypass station typically consists of two to three bypass conduits, which bypass the turbine, and a steam introduction appliance in the condenser neck. The mass flows through the bypass station are often larger than the turbine steam flow during normal turbine operation, particularly in the case of combined installations. Because the cross sections of the bypass conduits are much smaller than the cross section of the turbine exhaust steam connection, very strongly concentrated steam flows occur in the bypass conduits. In some cases, furthermore, the steam flows at supersonic velocity in the steam introduction appliance and this can lead to erosion damage to components in the condenser.

The space relationships at the condenser neck are limited, in some cases, because further installations also have to be located there. The pipework planning for the bypass conduits is therefore complicated and it is difficult to optimize the location of the introduction appliance at the condenser neck with respect to the flow dynamics.

In view of the prior art described here, the object of the invention is to create a steam condenser of modular construction, of the type described at the beginning, which avoids the disadvantages mentioned with respect to the connection of the modules.

SUMMARY OF THE INVENTION

The steam condenser modules arranged one above the other are, in accordance with the invention, separated from one another wherein a defined intermediate space exists between the adjacent modules, a plurality of connecting parts being arranged between the walls of the two modules which face one another.

Because of the distance between the modules provided by a defined intermediate space, the gap surfaces mentioned at the beginning and the associated risks of corrosion and stresses in the module walls are avoided. The intermediate space is expediently dimensioned in such a way that access for assembly operations and a visual inspection of the region of the module walls are made possible. Finally, the distance between the modules facilitates manufacture because both or all the modules can be identically manufactured and connected to one another by the connecting parts. In this arrangement, the number of weld seams necessary is also substantially reduced.

The connecting parts are used both for defining the space between the modules and for supporting the modules and, by this means, provide the advantage that the stress distribution in the central module walls is, as it were, defined. Furthermore, the stresses are no longer influenced by the manufacturing tolerances.

In addition, the adjacent modules are respectively connected by a connecting duct for the purpose of removing the condensate, which is produced in a module arranged above it and flows through a condensate drain opening in the bottom of each module into the module located underneath.

In a first embodiment example, the space between the modules is at atmospheric pressure. In an alternative embodiment example, the intermediate space is enclosed by side walls and is in connection, under vacuum, with the steam space. The first embodiment of the intermediate space at atmospheric pressure has the comparative advantage that the support of the modules requires fewer components and can therefore be realized in a simpler manner. The second embodiment, on the other hand, has the advantage that it permits simpler dewatering of the upper module without a plurality of individual connecting ducts.

In a preferred embodiment of the invention, the central, horizontally located module walls which face one another are arranged at a level such that they are located at the same level as the cylindrical walls of the water chambers. This arrangement advantageously contributes to the acceptance of the pressure forces from the water chambers. Bending moments, which otherwise occur due to the pressure from the water chambers on the central module walls, are avoided by this means. Ties or bracing ribs, which are otherwise necessary for accepting such bending moments, are no longer necessary, thus economizing in manufacturing and assembly costs.

In a further embodiment example of the invention, the connecting parts or straps have openings which can be used as transport suspension appliances.

In a further special embodiment, the intermediate space is used for locating bypass conduits. All the bypass conduits are preferably led from the same side of the condenser into the intermediate space and from there to a steam introduction appliance at the condenser neck. By this means, the intermediate space permits a greatly simplified conduit arrangement so that the conduits are shorter and similar flow relationships prevail in all conduits.

The steam introduction appliance is arranged at the level of the intermediate space. This has the advantage that the steam introduction appliance does not hinder the flow of turbine steam into the condenser because it is located in a "dead" zone relative to this steam flow. The steam introduction appliance has a perforated bypass collecting conduit with a plurality of tube pieces, which bypass collecting conduit extends over the complete width of the condenser neck. A bypass conduit leads to each of these tube pieces. Each tube piece has, as perforation, a plurality of rows of openings or orifice drillings through which the bypass steam enters the condenser neck.

The perforated bypass collecting conduit is, on the one hand, arranged in the same direction as the cooling water tubes of the condenser and is, on the other hand, arranged at the level of the intermediate space where there are no cooling tubes. Behind it, therefore, there is only the intermediate space so that no negative vortices occur there which would hinder the flow of turbine steam to the cooling tubes.

The multi-row orifice drillings extending over the complete length of the bypass collecting conduit and, therefore, over the complete width of the condenser neck additionally provide the advantage that the bypass steam is expanded to such an extent that the risk of erosion by the bypass steam on components in the condenser and the condenser neck is reduced.

BRIEF DESCRIPTION OF THE DRAWINGS

Preferred embodiments of the invention are disclosed in the following description and illustrated in the accompanying drawings, in which.

DETAILED DESCRIPTION OF THE INVENTION

Figure 1:
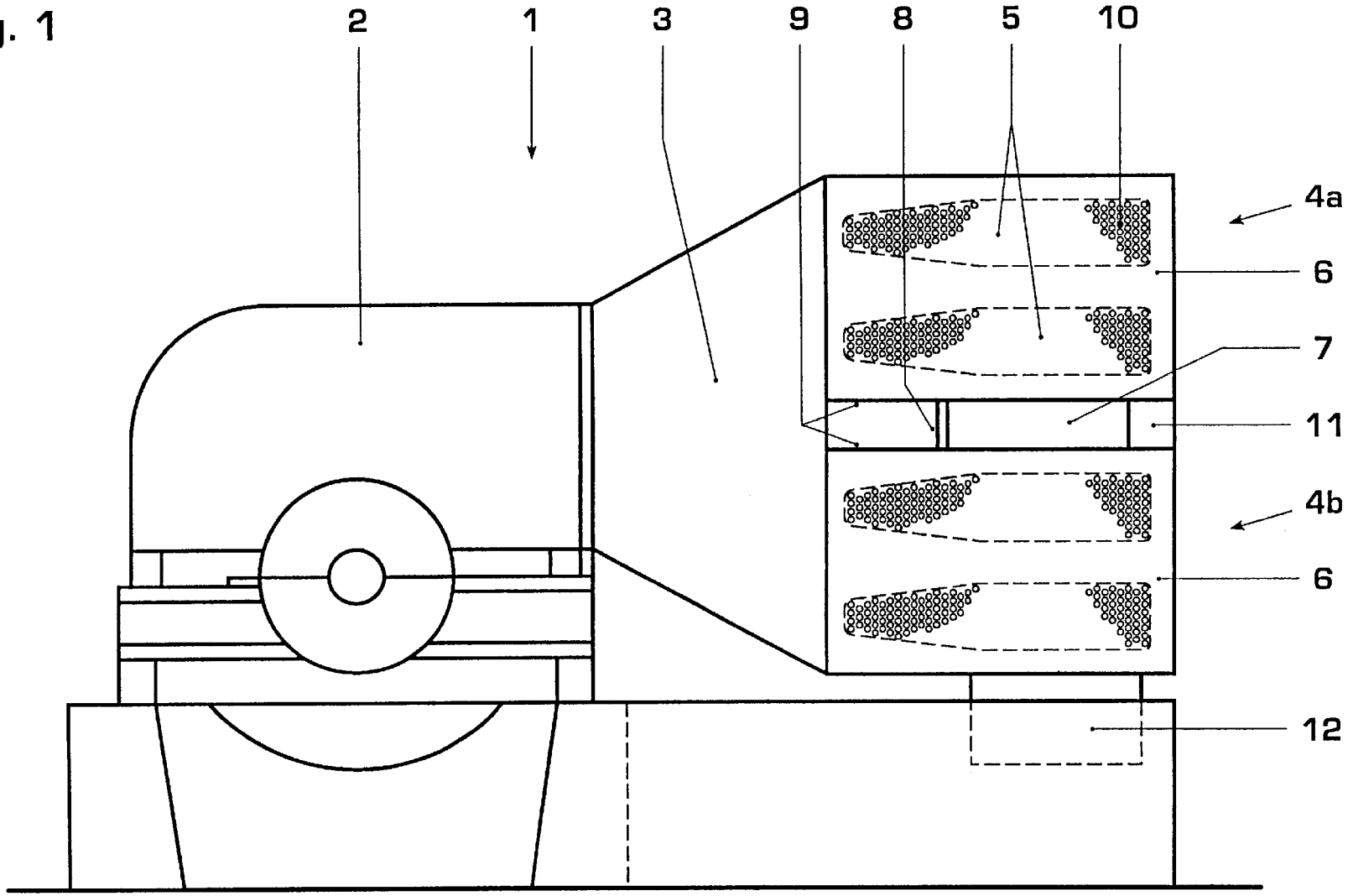
FIG. 1 shows a side view of a steam condenser, in accordance with the invention, with two modules which are separated from one another by an intermediate space and are connected together and supported by connecting parts.

FIG. 1 shows a steam condenser 1, which is arranged, relative to a turbine 2, at ground level and is connected to the turbine 2 by a condenser neck 3. The steam condenser 1 is constructed from two or more identical modules arranged one above the other, two modules 4*a,* 4*b* being present in the embodiment example shown. The modules 4*a,* 4*b* each have two tube bundles 5, which have an elongated configuration and are directed horizontally and between which there is a central passage or steam inlet flow passage. The steam space of each module 4*a,* 4*b* is enclosed by a steam jacket 6. The two modules 4*a,* 4*b* are separated from one another by an intermediate space 7, connecting parts 8 being arranged between the two modules. These connecting parts 8 connect together and support the central module walls 9 of the modules 4*a,* 4*b*. This connection and support arrangement provides a defined stress distribution in these central module walls 9.

The water chambers and deflection chambers for the cooling water of each tube bundle are of, for example, hemispherical configuration. (They are not shown in this figure and are subsequently described in association with FIG. 2.)

The steam from the turbine 2 flows in the horizontal direction through the condenser neck 3 to the steam condenser 1 and there flows initially into the central passages of the two modules 4*a,* 4*b* and from there into the tube bundles 5, where it condenses on the tubes 10. The condensate which is produced in the module 4*a* arranged above flows to the bottom of this module and there to a condensate drain opening which opens into a connecting duct 11. By this means, the condensate finally reaches the module 4*b* arranged underneath where, together with the condensate produced there, it is collected in the hotwell 12.

Figure 2:
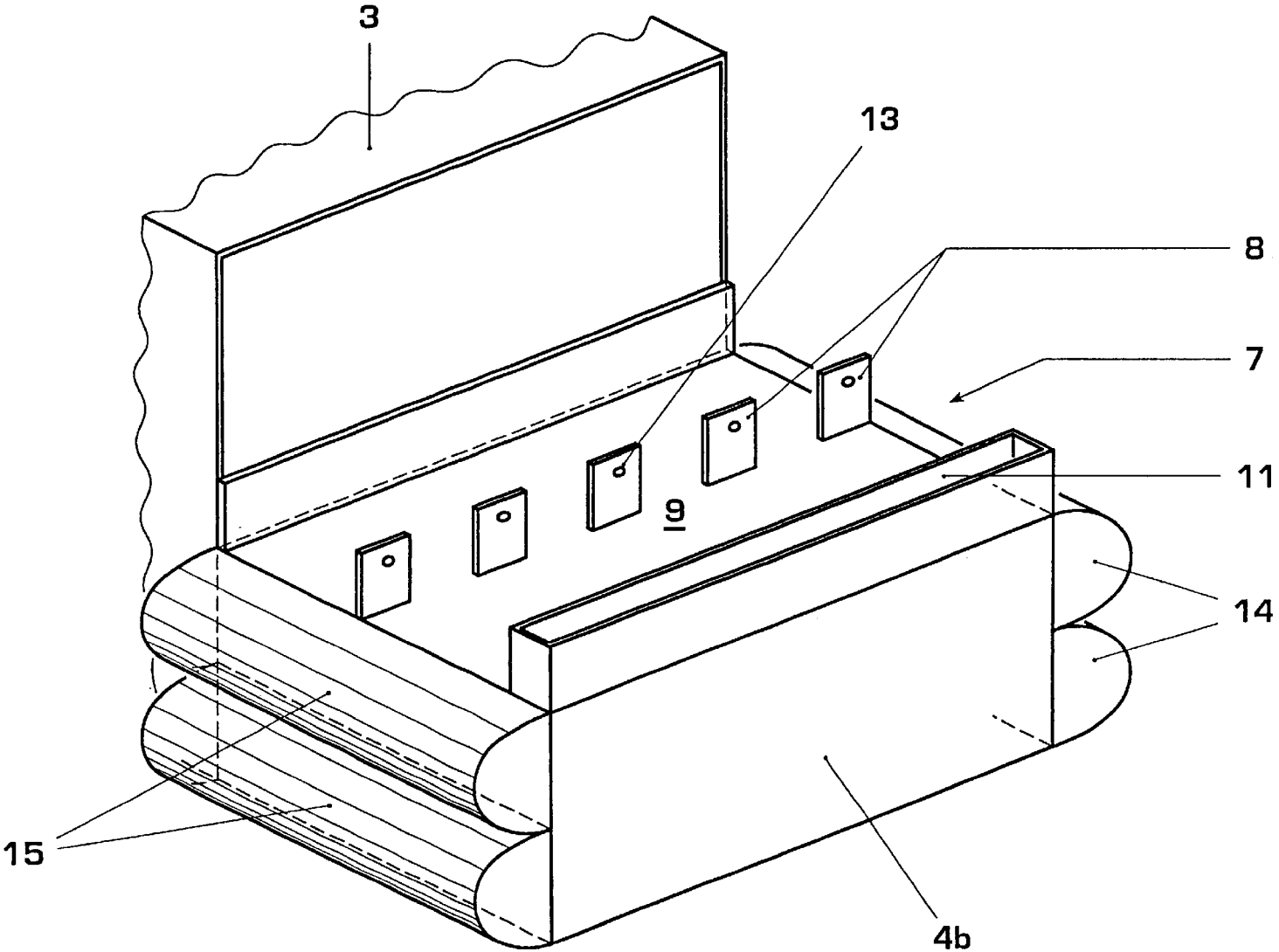
FIG. 2 shows a diagrammatic view of an intermediate space with connecting parts and connecting ducts and also shows the water chambers.

FIG. 2 shows the intermediate space 7 with the connecting parts 8 and the connecting duct 11. (For better viewing, the upper module is not shown.) The connecting parts 8 consist, for example, of a plurality of individual pieces which are distributed over the width of the module. Together with the connecting duct 11, they are used for supporting the upper module.

For transport purposes, the connecting parts 8 have openings or eyes 13 which are used during suspension from a crane. In consequence, the connecting parts have a double use, that of connection and support during operation and that of transport and installation aid.

In the embodiment shown here, the intermediate space 7 is under atmospheric pressure. In a variant, the intermediate space is under vacuum, the intermediate space being in connection with the steam space of the two modules. For this purpose, the connection between the two modules requires additional side walls which are welded to the side walls of the modules. This variant permits direct dewatering of the upper module without individual connecting ducts.

In the embodiment shown here, water chambers 14 are arranged relative to the modules 4*a* and 4*b* (the module 4*a* is not shown here for purposes of better representation) in such a way that the semi-cylindrical walls 15 of the water chambers 14 are located at the same level as the central walls 9 of the modules. This means that the jacket 15 of the semi-cylindrical water chambers 14 is respectively connected to the module 4*b* at the level of the central module wall 9. By this means, the pressure forces which derive from the water chambers are accepted by the central walls 9. No bending moments occur in the central walls 9, in particular, so that it is not necessary to install any additional bracing ribs or ties in order to accept these bending moments.

Figure 3:
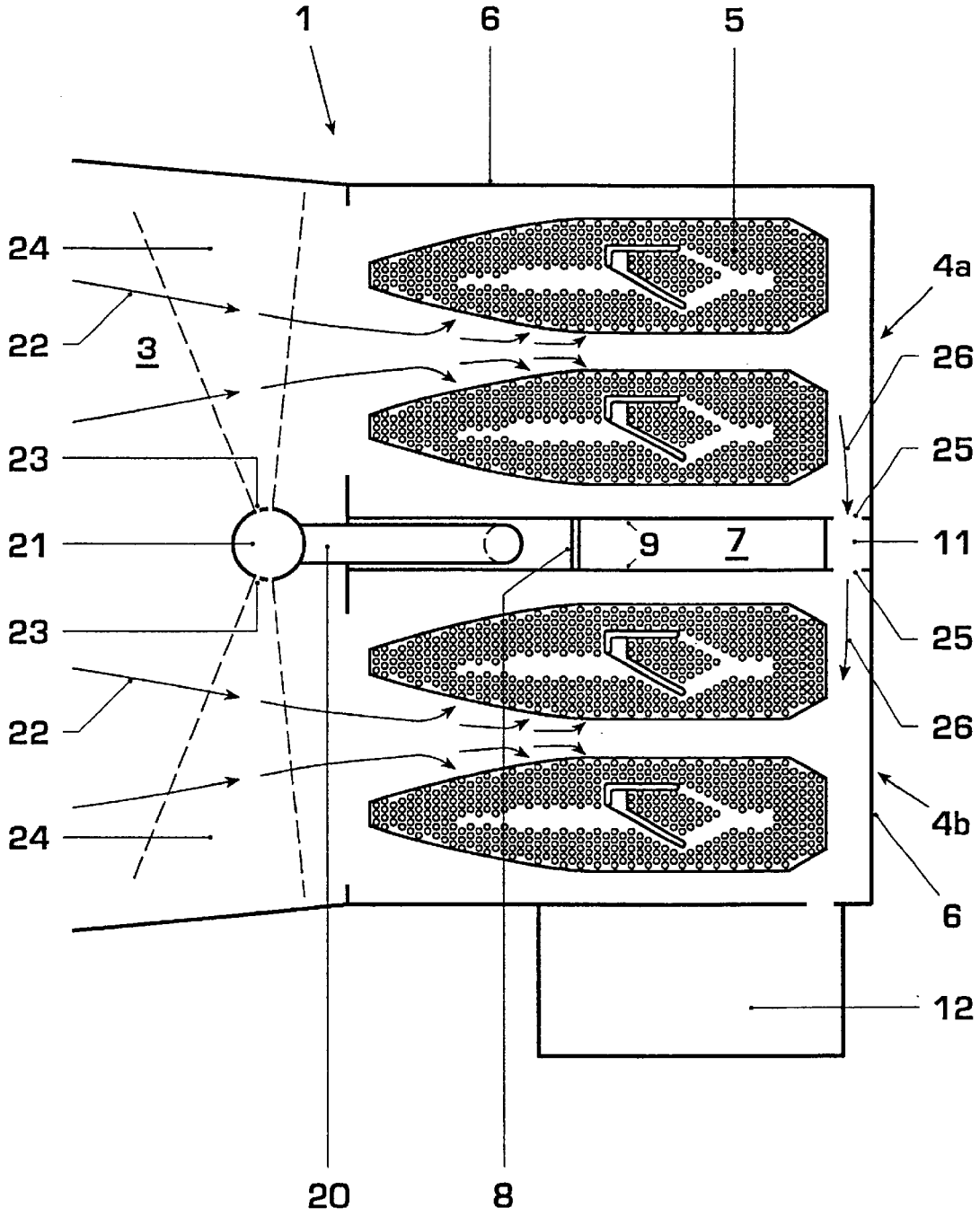
FIG. 3 shows a vertical section through the steam condenser, in accordance with the invention, with bypass conduits in the region of the intermediate space and a steam introduction appliance.

FIG. 3 shows, in section, the steam condenser 1 with two modules 4*a,* 4*b,* which are separated from one another by the intermediate space 7. One or more bypass conduits 20 are led into the intermediate space 7, one of which bypass conduits being visible in this section. The bypass conduits lead from the boiler (not shown), bypassing the turbine, directly into the condenser neck 3 and there to a steam introduction appliance 21. In accordance with the invention, this is positioned at the level of the intermediate space 7, i.e. between the two modules 4*a,* 4*b*. The steam inlet flow 22 from the turbine 2 into the condenser 1 is not hindered by this positioning of the steam introduction appliance 21. In consequence, no negative vortices or so-called Karman vortex streets occur in the region of the cooling tubes. The steam introduction appliance has a steam collecting conduit 21 which has, on its upper and lower surfaces, i.e. on both sides of the intermediate space 7, a multiplicity of outlet flow openings or orifice openings 23. The bypass steam flow from the bypass conduits 20 is expanded in the collecting conduits 21 and then emerges through the openings 23 into the condenser neck 3. The outlet flow region 24 of the bypass steam is indicated by dashed lines. In comparison with conventional steam introduction appliances, it is wider; this contributes to the fact that the inlet flow velocity of the bypass steam is lower and the erosion on the components in the condenser is reduced.

The central module walls 9 each have openings 25 which are used for the drainage of the condensate 26 from the upper module 4*a* through the connecting duct 11 into the lower module 4*b*. From there, the condensate, together with the condensate from the lower module, finally passes into the hotwell 12 at this point.

Figure 4:
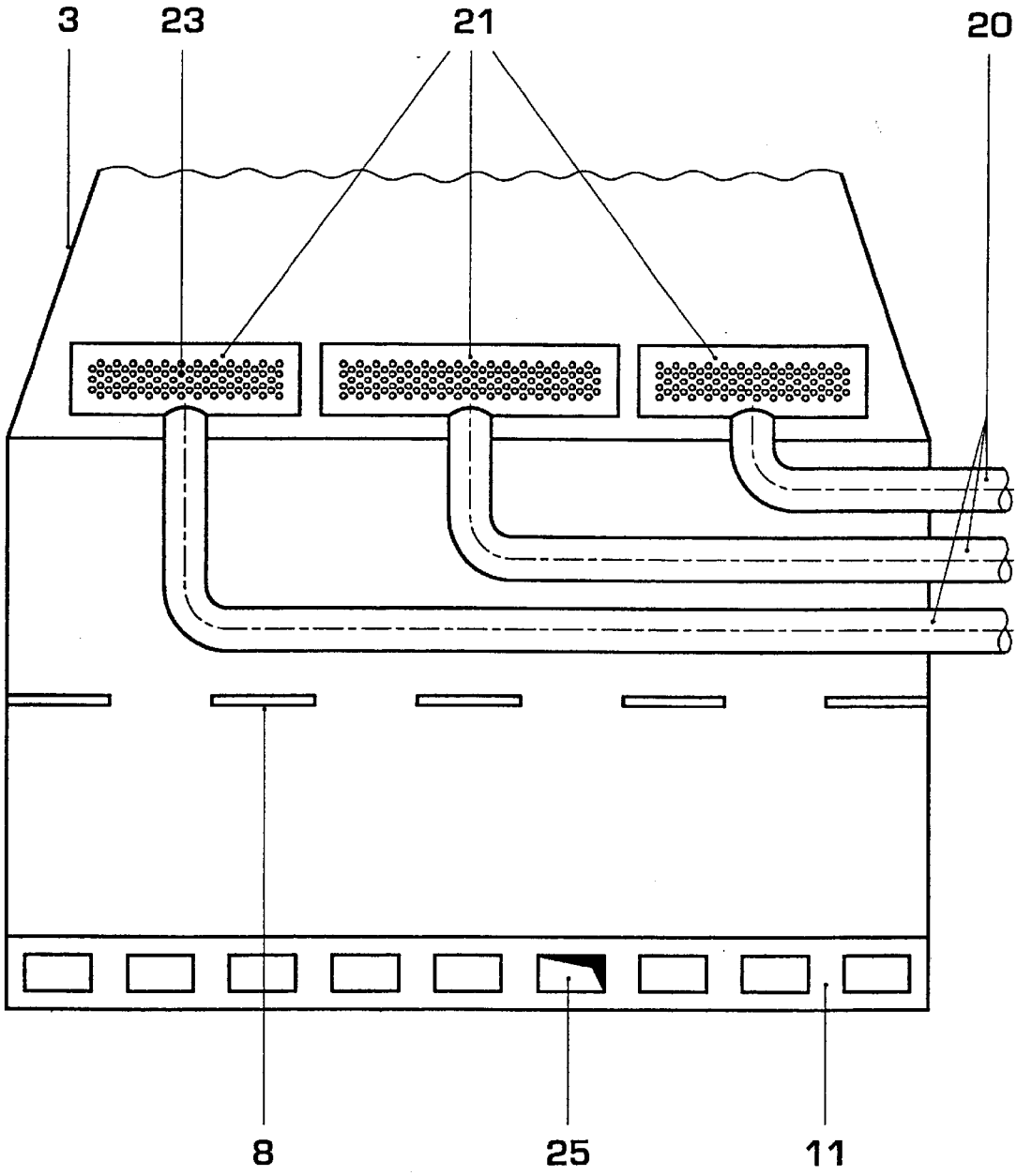
FIG. 4 shows a horizontal section through the steam condenser, in accordance with the invention, of FIG. 3 at the level of the intermediate space.

FIG. 4 shows, in a further section through the intermediate space, the arrangement of three bypass conduits 20. All the conduits lead from the same side of the condenser through the intermediate space 7 into the condenser neck 3. This arrangement permits the use of shorter conduits and the use of similarly designed and therefore lower-cost conduits. In addition, the assembly of conduits is facilitated in this arrangement. Three steam collecting conduits 21, which are arranged evenly distributed over the width of the condenser neck 3, are arranged in the condenser neck 3. Each bypass conduit 20 leads to a steam collecting conduit 21 associated with it. Each collecting conduit 21 has, over its complete length, a plurality of rows of outlet flow openings 23, through which the bypass steam flows into the condenser neck. In the example shown, these are circular openings. The plurality of condensate drain openings 25 are here, for example, arranged over the entire width of the connecting duct The principles, preferred embodiments and manner of use of the present invention have been described in the foregoing specification. However, the invention which is intended to be protected is not to be construed as limited to the particular embodiments described. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the invention be embraced thereby.

What is claimed is:

1. A steam condenser, which, relative to a steam turbine, is arranged at equal ground level and to which the turbine steam flows in the horizontal direction through a condenser neck and which has two or more modules, which are arranged one above the other and are each enclosed by a steam jacket and in whose steam spaces are contained respective tube bundles with cooling tubes, through which cooling water from water chambers flows, wherein the two or more modules are respectively separated from one another by a defined intermediate space and connecting parts are respectively arranged in the intermediate space or the intermediate spaces, which connecting parts support the mutually adjacent modules.

2. The steam condenser as claimed in claim 1, wherein one connecting duct, in which condensate produced in the module arranged above flows via condensate drain openings and from there reaches the module arranged underneath via an opening, is respectively arranged between the adjacent modules.

3. The steam condenser as claimed in claim 2, wherein each intermediate space between two adjacent modules is at atmospheric pressure.

4. The steam condenser as claimed in claim 2, wherein the respective intermediate space between two adjacent modules has side walls and the intermediate space is surrounded by the side walls, the connecting duct and a wall at the end of the condenser neck, and the intermediate space is in connection with the steam spaces of the modules and is under vacuum.

5. The steam condenser as claimed in claim 3, wherein the semi-cylindrical walls of the water chambers are connected to the modules at the level of the mutually facing central walls of the modules.

6. The steam condenser as claimed in claim 3, wherein one or more bypass conduits are arranged in the intermediate space and lead to a steam introduction appliance, which is arranged at the condenser neck at the level of the intermediate space.

7. The steam condenser as claimed in claim 6, wherein the steam introduction appliance has a collecting conduit for each bypass conduit, which bypass conduits are arranged distributed over the width of the condenser neck.

8. The steam condenser as claimed in claim 6, wherein the steam introducing appliance has outlet flow openings through which the bypass steam flows into the condenser neck.

9. The steam condenser as claimed in claim 8, wherein the outlet flow openings have a circular configuration.

10. A steam condenser, comprising:

a condenser neck having two or more modules, said modules being arranged one above the other and are each enclosed by a steam jacket, said modules having steam spaces containing tube bundles with cooling tubes, through which cooling water flows, said modules being separated from one another by a defined intermediate space or spaces and connecting parts are respectively arranged in the intermediate space or the intermediate spaces, which connecting parts support the mutually adjacent modules.

11. The steam condenser as claimed in claim 10, wherein one connecting duct, in which condensate produced in a module arranged on a top of the condenser, flows via condensate drain openings and from there reaches the module arranged at a bottom of the condenser via an opening, is respectively arranged between the adjacent modules.

12. The steam condenser as claimed in claim 10, wherein each intermediate space between two adjacent modules is at atmospheric pressure.

13. The steam condenser as claimed in claim 10, wherein the respective intermediate space between two adjacent modules has side walls and the intermediate space is surrounded by the side walls, the connecting duct and a wall at the end of the condenser neck, and the intermediate space is in connection with the steam spaces of the modules and is under vacuum.

14. The steam condenser as claimed in claim 10, wherein semi-cylindrical walls of water chambers are connected to the modules at a level of the mutually facing central walls of the modules.

15. The steam condenser as claimed in claim 10, wherein one or more bypass conduits are arranged in the intermediate space and lead to a steam introduction appliance, which is arranged at the condenser neck at the level of the intermediate space.

16. The steam condenser as claimed in claim 10, wherein the steam introduction appliance has a collecting conduit for each bypass conduit, which bypass conduits are arranged distributed over the width of the condenser neck.

17. The steam condenser as claimed in claim 10, wherein the steam introduction appliance has outlet flow openings through which the bypass steam flows into the condenser neck.

18. The steam condenser as claimed in claim 10, wherein the outlet flow openings have a circular configuration.

* * * * *